US007059156B2

(12) United States Patent
Takeda et al.

(10) Patent No.: US 7,059,156 B2
(45) Date of Patent: Jun. 13, 2006

(54) METHOD FOR KNITTING SOCKS

(75) Inventors: Daisuke Takeda, Fujimi (JP); Susumu Takeda, Fujimi (JP)

(73) Assignee: Takeda Leg Wear Co., Ltd. (JP)

( * ) Notice: Subject to any disclaimer, the term of this patent is extended or adjusted under 35 U.S.C. 154(b) by 0 days.

(21) Appl. No.: 10/523,298

(22) PCT Filed: Aug. 6, 2002

(86) PCT No.: PCT/JP02/08014

§ 371 (c)(1),
(2), (4) Date: Feb. 3, 2005

(87) PCT Pub. No.: WO2004/012537

PCT Pub. Date: Feb. 12, 2004

(65) Prior Publication Data

US 2005/0235702 A1 Oct. 27, 2005

(51) Int. Cl.
*D04B 9/20* (2006.01)

(52) U.S. Cl. ..... 66/51; 66/186

(58) Field of Classification Search ..... 66/169 R, 66/178 R, 185–187, 21, 30, 51
See application file for complete search history.

(56) References Cited

U.S. PATENT DOCUMENTS 2,663,175 A * 12/1953 Pons ..... 66/179
3,006,169 A * 10/1961 Strunk ..... 66/48
5,211,035 A * 5/1993 Hanson, II ..... 66/51
6,000,247 A 12/1999 Takeda et al.

FOREIGN PATENT DOCUMENTS

| | | |
|---|---|---|
| JP | H10-259505 | 9/1998 |
| JP | H11-001849 | 1/1999 |
| JP | H11-021703 | 1/1999 |
| JP | 3070670 | 5/2000 |

* cited by examiner

*Primary Examiner*—Danny Worrell
(74) *Attorney, Agent, or Firm*—Akerman Senterfitt; Stephan A. Pendorf

(57) ABSTRACT

When knitting the sole section and instep section of the toe section, knitting is performed while sequentially decreasing the number of stitches on the small-toe side of the toes by a specified number, and after the number of stitches on the large-toe side has been decreased by a ratio larger than the ratio of decreasing the number of stitches on the small-toe side, the number is increased by the same ratio, and by doing this, on the small-toe side, the side edge section goes toward the tip end and deviates to the inside at a specified ratio, and on the large-toe side, side edge section is nearly a straight line toward the tip end, and by doing this, the shape of the tip end of the toe section protrudes such that it gradually extends to the front of the toes going from the small-toe side to the large-toe side, and that shape is such that it runs along the curve that is obtained by connecting the tip ends of the toes.

4 Claims, 11 Drawing Sheets

METHOD FOR KNITTING SOCKS

CROSS REFERENCE TO RELATED APPLICATION

This application is a national stage of PCT/JP2002/008014 filed Aug. 6, 2002 under the International Convention.

BACKGROUND OF THE INVENTION

1. Field of the Invention

This invention relates to a method for knitting socks, and particularly to a socks that have little feeling of constriction when worn.

2. Description of the Related Art

Generally, a sock as shown by reference number 1 in FIG. 9 comprises: a tubular knit section 2 that has a foot-insert section 2*a* and that extends from near the ankle of the foot to the instep and arch of the foot; and a toe section 3 that is connected to the tubular-knit section 2 in a tapering shape and covers the toes, and where particularly, as shown in FIG. 10, this toe section 3 is formed such that it has a tapered shape and such that it has right-left symmetry in the width direction of the foot, and furthermore, as shown in FIG. 11, this toe section 3 comprises a sole section 3*a* that covers the lower half of the toes, and a instep section 3*b* that covers the upper half of the toes, and the sole section 3*a* and instep section 3*b* are formed into a flat tubular shape and closed on the tip end by knitting them together into a flat shape.

Incidentally, normally the toes are such that the large toe side is long and the small toe side is short.

However, the toe section 3 of the sock described above is formed such that it has right-left symmetry in the width direction of the foot, so after the sock is worn, the large-toe side is stretched and there is extra space on the small-toe side.

Due to this, the phenomenon occurs that there is a feeling of pressure on the large-toe side, and because the large-toe side of the toe section 3 is greatly stretched, the large-toe side soon becomes damaged On the other hand, when putting the sock 1 on, the foot is inserted from the insert section 2*a*, and the toes are inserted into the flat toe section 3 and are inserted while stretching the sole section 3*a* and the instep section 3*b* in the vertical direction.

Therefore, particularly, the wearer feels a tight fit around the toes in the tapered toe section 3, and after the sock is put on, feels tight constriction around the toes.

Taking this kind of problem into consideration, the object of this invention is to provide a method of knitting socks that make it possible to obtain a sock that particularly loosens the fit in the tapered toe section, and reduces the feeling of constriction after the sock is put on.

SUMMARY OF THE INVENTION

The method for knitting socks of this invention is a knitting method of forming the toe section into a cylindrical shape by knitting the toe section of the sock that covers the toes continuously from either the sole section or instep section to the other, and when knitting the sole section and instep section, knitting is performed while sequentially reducing by a specified amount the number of stitches of the small-toe side, and after the number of stitches of the large-toe side have been reduced at a larger rate than the rate of reducing the number of stitches on the small-toe side, the number of stitches is increased at the same rate.

With this kind of knitting method for knitting socks, on the small-toe side, the edge deviates toward the inside at a specified rate toward the tip end, and on the large-toe side, in the area where increasing and decreasing the number of stitches is performed, the appearance is such that the edge on that side is nearly linear toward the tip end.

By doing this, the shape of the tip end of the toe section going from the small-toe side to the large-toe side is such that the large-toe side has a protruding shape that gradually extends forward toward the front of the toes, and is formed such that it follows a curve that connects the tip of the toes.

As a result, the felling of pressure is relieved by the difference in the length of the toes.

The method for knitting socks of this invention is characterized by meticulously repeating the increase and decrease of the number stitches on the large toe side at a minimum increase-decrease rate.

With this kind of method for knitting socks, it is possible to reduce the amount of deviation of the edge of the large-toe side toward the inside.

Therefore, the shape of the tip end of the toe section can be easily adjusted to correspond with the curve obtained by connecting the tip ends of the inserted toes.

The method for knitting socks of this invention is characterized by meticulously repeating the increase and decrease of the number stitches on the large toe side at a minimum increase-decrease rate.

With this kind of method for knitting socks, a bulge section is formed on the side of the large toe that bulges in the thickness direction of the sock, and by doing so, it becomes easier to insert that large toe.

The method for knitting socks of this invention is characterized by forming the toe section such that it is divided into a first insert section into which the large toe is inserted, and a second insert section into which the other toes are inserted, and where in both this first insert section 1 and second insert section 2, the number of stitches are increased and decreased when knitting the sole section an instep section.

With this kind of construction, while maintaining the improvement of fit and feeling of construction described above, the toe section is located between the large toe and other toes, so it is possible to suppress shifting of the position of the toe section and toes, and thus possible to improve the fit.

Furthermore, the method of knitting socks of this invention is characterized by forming the toe section such that it is divided into five insert sections into which the toes are inserted individually, and in each of these five insert sections, the number of stitches are increased and decreased when knitting the sole section and instep section.

With this kind of construction, while maintaining the improvement of fit and feeling of constriction described above, it is possible to further suppress shifting of the position of the toe sections and toes, and thus possible to improve the fit even more.

DESCRIPTION OF THE PREFERRED EMBODIMENTS

In order explain the invention in more detail, the invention will be explained with reference to the accompanying drawings.

First Embodiment

Figure 1:
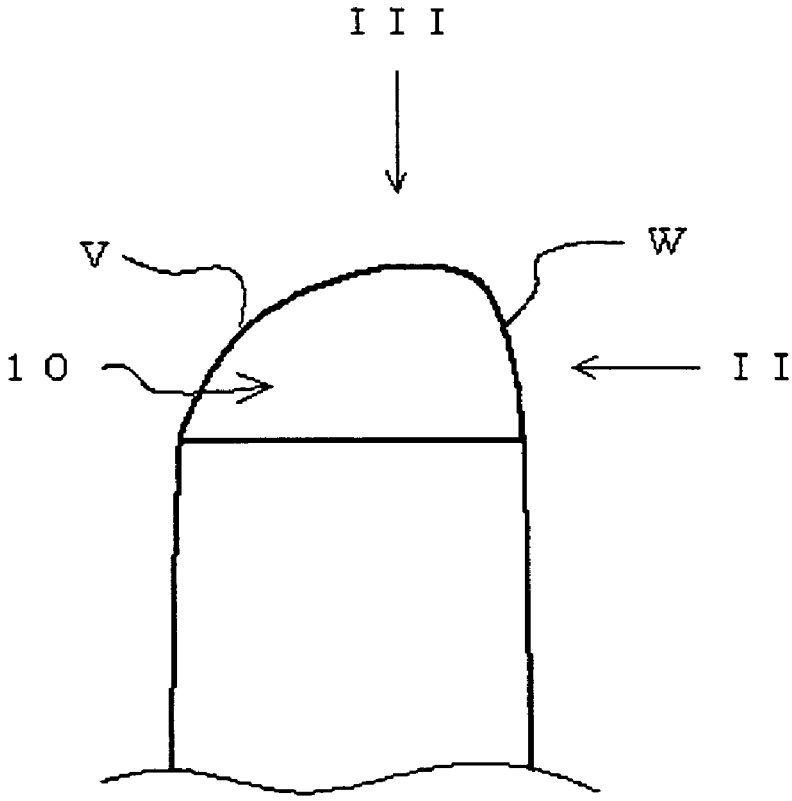
FIG. 1 is a top view showing the toe section of a first embodiment of the invention.
Figure 2:
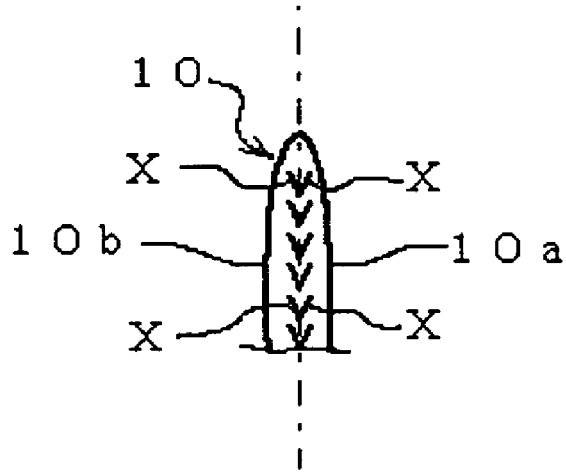
FIG. 2 is a view in the direction of the arrow II in FIG. 1.
Figure 3:
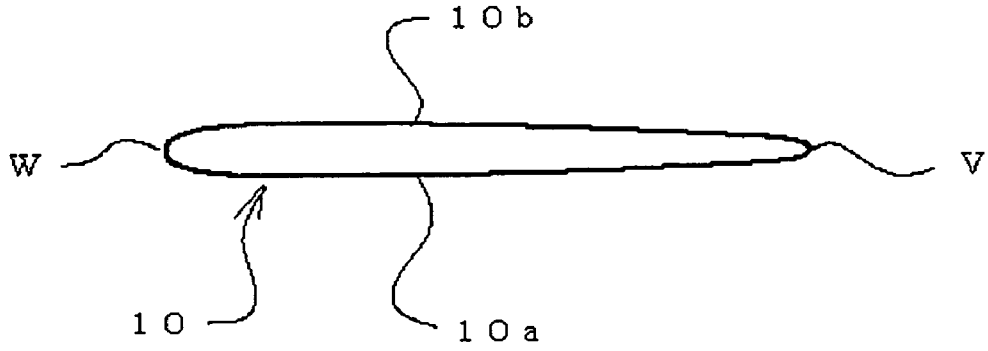
FIG. 3 is an enlarged view in the direction of the arrow III in FIG. 1.

FIG. 1 to FIG. 3 show the toe section 10 of a sock that was obtained by the knitting method of a first embodiment of the invention, and the example shown in the figure is for the left foot.

Figure 9:
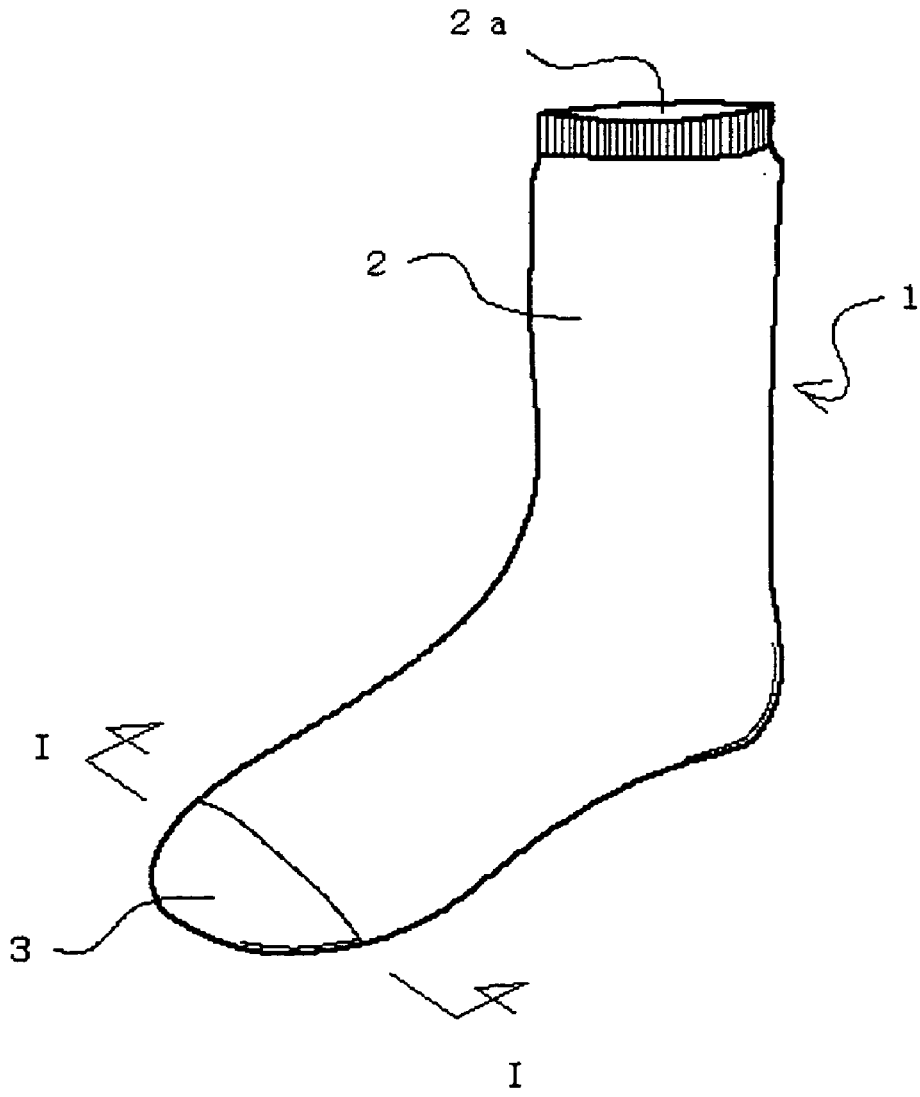
FIG. 9 is a perspective view of a sock knitted by a conventional knitting method.
Figure 10:
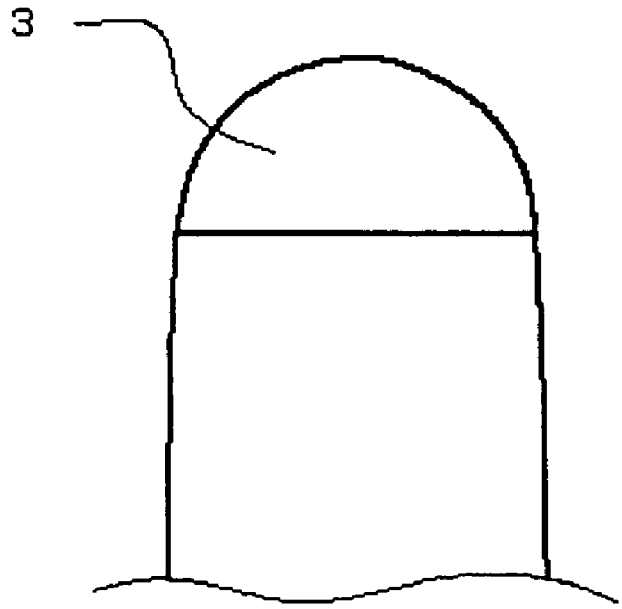
FIG. 10 is a top view of the tip end section of the sock shown in FIG. 9.
Figure 11:
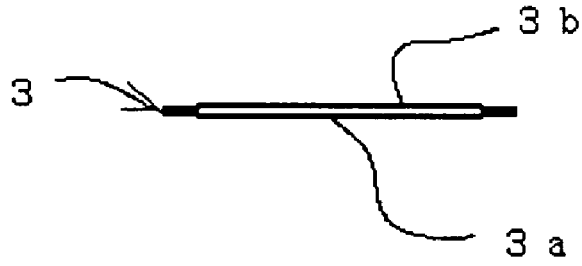
FIG. 11 is a cross-sectional view of the section I—I in FIG. 9.

FIG. 1 is a top view of the toe section 10, FIG. 2 is a side view as seen from the direction of the arrow II in FIG. 1, FIG. 3 is an enlarged front view as seen from the direction of the arrow III in FIG. 1, the other parts that are common with those shown in FIG. 9 will be explained using FIG. 9 and the reference numbers used in FIG. 9.

The toe section 10 knitted into an overall flat cylindrical shape comprising a sole section 10*a* that covers the lower part of the toes and an instep section 10*b* that covers the top part of the toes.

In this embodiment, the toe section 10 of the sock that covers the toes is formed into a cylindrical shape by continuously knitting from the sole section 10*a* to the instep section 10*b*, and when knitting the sole section 10*a* or instep section 10*b*, knitting is performed while sequentially decreasing the number of stitches by a specified number on the small-toe side V, and after the number of stitches on the large-toe side W have been decreased by a ratio that is larger than ratio that the number of stitches on the small-toe side V are decreased, it is increased by the same ratio.

A typically used circular knitting machine will be used as the sock knitting machine in order to explain in detail the method for performing this kind of knitting.

This circular knitting machine rotates in a fixed direction a needle cylinder in which a plurality of knitting needles are located around its circumference and performs a rotating knitting operation, and alternately rotates this needle cylinder in the opposite direction to perform a partial-knitting operation of the area being knitted, and by performing the rotating-knitting operation it knits the cylindrical knitted section 2, and by performing the partial-knitting, it knits the toe section 10 into a cylindrical shape by first knitting the sole section 10*a* and then continuing with knitting the instep section 10*b*.

Also, when knitting the sole section 10*a* and instep section 10*b*, after performing knitting by rotating the needle cylinder from the large-toe side W to the small-toe side V, knitting is performed by rotating this needle cylinder in the opposite direction toward the large-toe side W.

Moreover, at the instant when knitting is completed up to the small-toe side V, the number of knitting needles is reduced by a fixed number of knitting needles, for example one needle, and then knitting is performed to the large-toe side W, next, at the instant when knitting is completed up to the large-toe side W, the number of knitting needles is reduced by two needles and knitting is performed to the small-toe side, then instant when knitting is completed up to the small-toe side V, the number of knitting needles is reduced by one needle and knitting is performed to the large-toe side, and then the number of knitting needles at this large-toe side W is increased by two needles and knitting is performed to the small-toe side, furthermore, on the small-toe side V the number of knitting needles is reduced by one needle and again knitting is performed to the large-toe side.

With this kind of operation, a knitted line is formed on the large-toe side indicated by the X in FIG. 2.

Here, on the small-toe side V the stitches are continuously reduced at a fixed rate, and on the large-toe side W after the stitches are reduced somewhat, they stitches are increased, and the number that the stitches are decreased on this large-toe side W is the same as the number that the stitches are increased.

Also, the tip end section of the knitting on the small-toe side V gradually moves to the side of the toes, and gradually deviates toward the inside of the toes, however, on the large-toe side W, the position of the knitting returns to the starting position, and this starting position does not deviate.

Next, on the large-toe side W, as on the small-toe side V, knitting is performed such that one knitting needle is decreased for just a specified length toward the tip of the toes.

From this operation of performing knitting by just decreasing the knitting needles on the large-toe side W, the tip end section of the knitting on this large-toe side W moves toward the side of the toes in the same was as on the small-toe side V, and deviates toward the inside of the toes.

After this, on the large-toe side W, knitting is performed such that the number of knitting needles is increased two needles at a time as described above.

By repeatedly performing this kind of knitting operation, on the small-toe side V, the side edge forms a path that goes to the tip side of the toes and gradually deviates toward the inside of the toes, and on the large-toe side W, the side edge forms a path that after maintaining a constant position, goes to the tip side of the toes, and deviates toward the inside of the toes.

Therefore, as shown in FIG. 1, the shape of the tip end section of the sole section 10*a* is formed such that the large-toe side is long and the small-toe side is short, and comes close to the curve obtained by connecting the tip end section of the toes.

Also, after knitting of the sole section 10*a* is performed by the knitting operation described above, by continuing and performing knitting of the instep section 10*b*, the base ends sections of the knitting lines X that are formed on the sole section 10*a* and instep section 10*b* match as shown in FIG. 2, and to connect both side edges of the sole section 10*a* and both side edges of the instep section 10*b*, to form the cylindrical toe section 10 as shown in FIG. 3.

In this embodiment, by shaping the toe section 10 such that it is close to the shape of the curve obtained by connecting the tip end sections of the toes in this way, there is nearly uniform contact between the toe section 10 and the tip ends of the toes when putting the sock on, and the feeling of uneven pressure is reduced and stretching of the toe section is uniform, and because of this, partial damage is suppressed.

On the other hand, in the section on the large-toe sued W formed by the knitting lines X, the position of that knitting does not deviate toward the tip of the toes, so that amount forms a bulge section that bulges in the thickness direction, and as shown in FIG. 3, the large-toe side has somewhat of a bulge shape.

Therefore, when putting the sock on and the toes are inserted into the toe section 10, the toe section is deformed such that it is stretched in forward-backward direction and the up-down direction of the toes, however, by forming the bulge section in the area where the large toe is inserted, the insertion resistance is reduced, and together with obtaining a good fit, there is little stretching in that bulge section after the sock has been put on, so the constriction force applied to the toes is reduced, and as a result the feeling of constriction is reduced and a comfortable fit is obtained.

Second Embodiment

Figure 4:
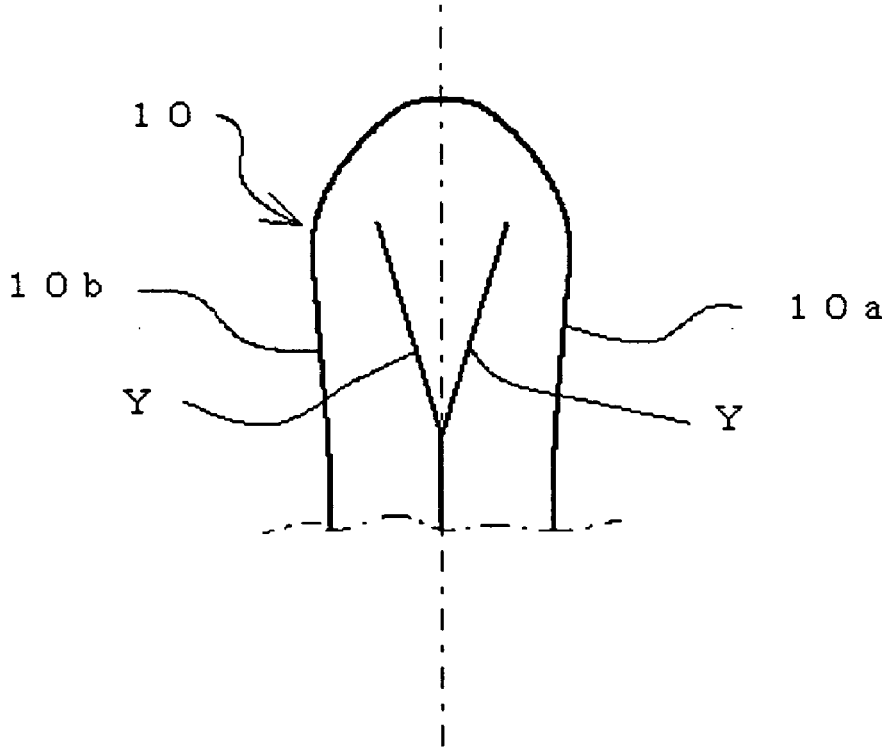
FIG. 4 is a side view of the toe section of a second embodiment of the invention.
Figure 5:
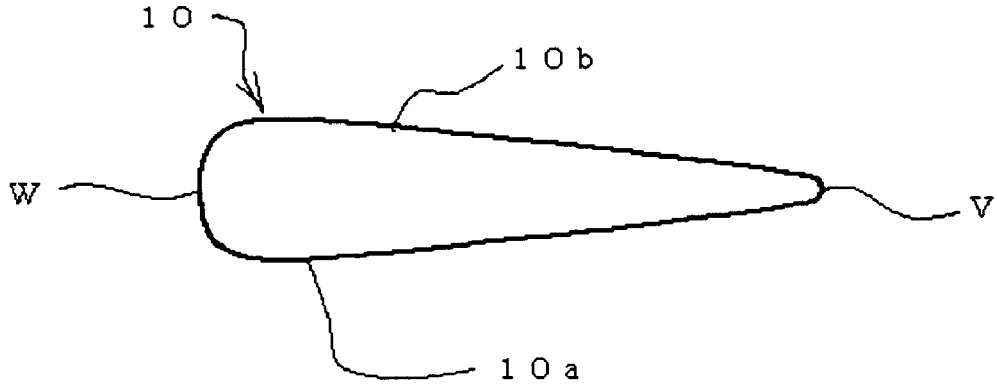
FIG. 5 is a front view of the toe section of the second embodiment of the invention.

FIG. 4 and FIG. 5 show a second embodiment of the invention.

This embodiment is an example in which the stitches on the large-toe side W of the sole section 10*a* and instep section 10*b* are continuously decreased such that the knitting line Y becomes one long continuous line.

In this case as well, the amount that the stitches are reduced on the small-toe side V is kept constant, and on the large-toe side W, the amount of increasing and decreasing the stitches is larger than the amount of decreasing the stitches on the small-toe side V.

With the knitting method of this kind of embodiment, for the same reasons as in the first embodiment, the length of the area where the large toe is inserted is longer in comparison with the small-toe side, and the by formed the knitting line Y such that it is a continuous long line, area of the bulge section formed on the large-toe side W is enlarged, and as shown in FIG. 5, the space of the area where the large-toe is inserted is enlarged.

As a result, the large toe can be inserted smoothly when putting the sock on, and the feeling of constriction around the large toe is further relieved.

Figure 6:
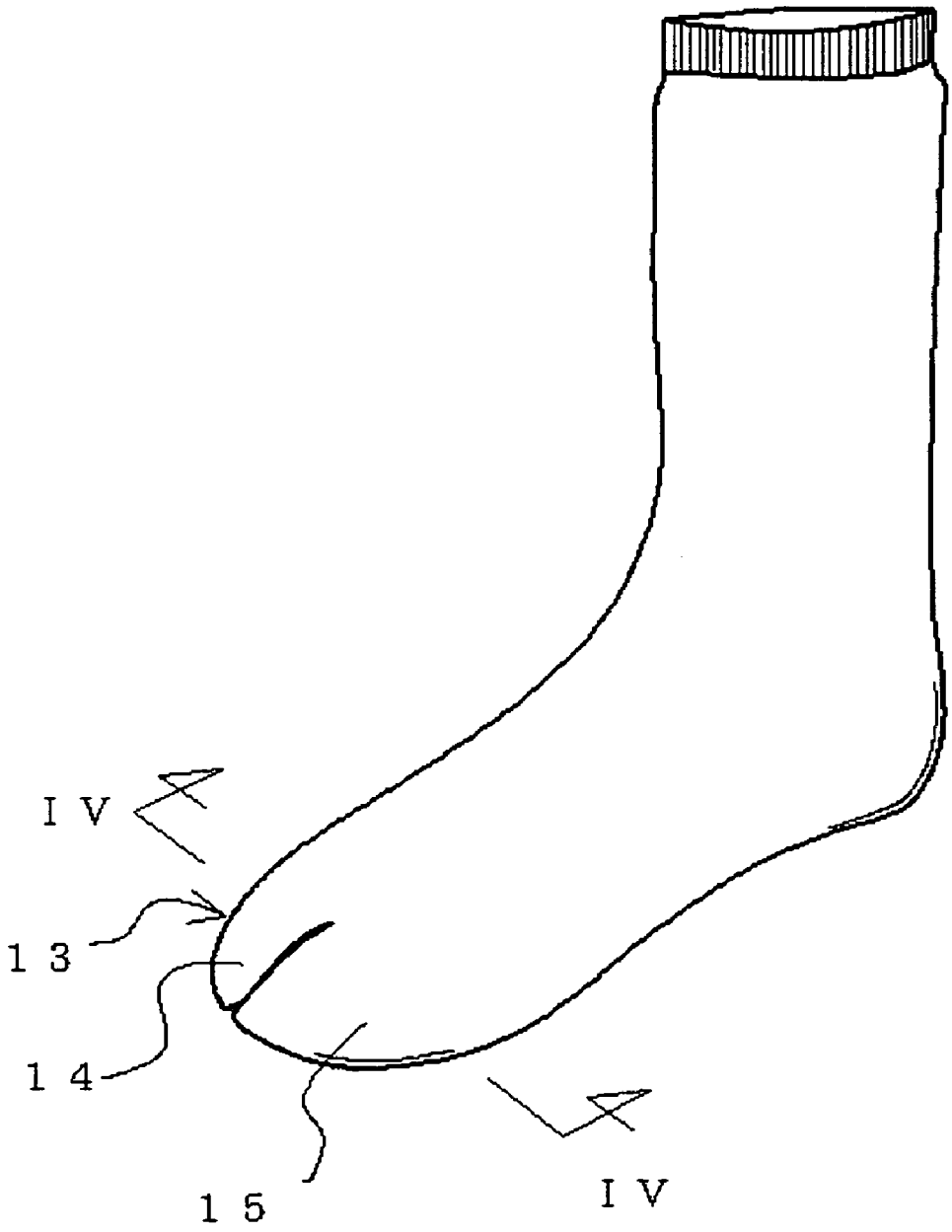
FIG. 6 is a pictorial view showing the external appearance of an example of a change in shape of the invention.
Figure 7:
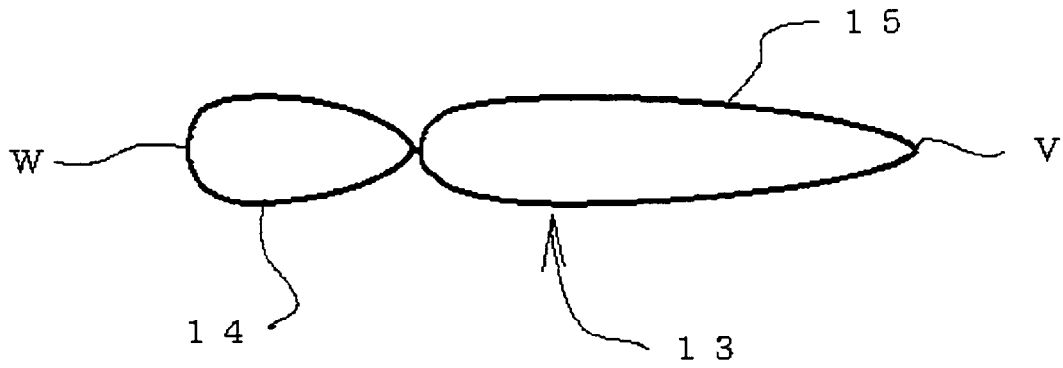
FIG. 7 is a cross-sectional view of the section IV—IV in FIG. 6.

On the other hand, as in the toe section indicated by reference number 13 in FIG. 6, it is possible to divide this toe section 13 into a first insert section 14 into which the large toe is inserted and a second insert section 15 into which the other toes are inserted; and by applying the knitting method of the first embodiment and the second embodiment described above to both the first insert section 14 and second insert section 15, the toe section is formed such that it gradually becomes longer going toward the large-toe side, and such that a bulge section is formed as shown in FIG. 7.

By forming the toe section 13 such that it is divided into a first insert section 14 and a second insert section 15 in this way, the toe section 13 is held between the large toe and the adjacent toe, so it is possible to shifting of the toe section 13 and the toes, and to improve the fit.

Figure 8:
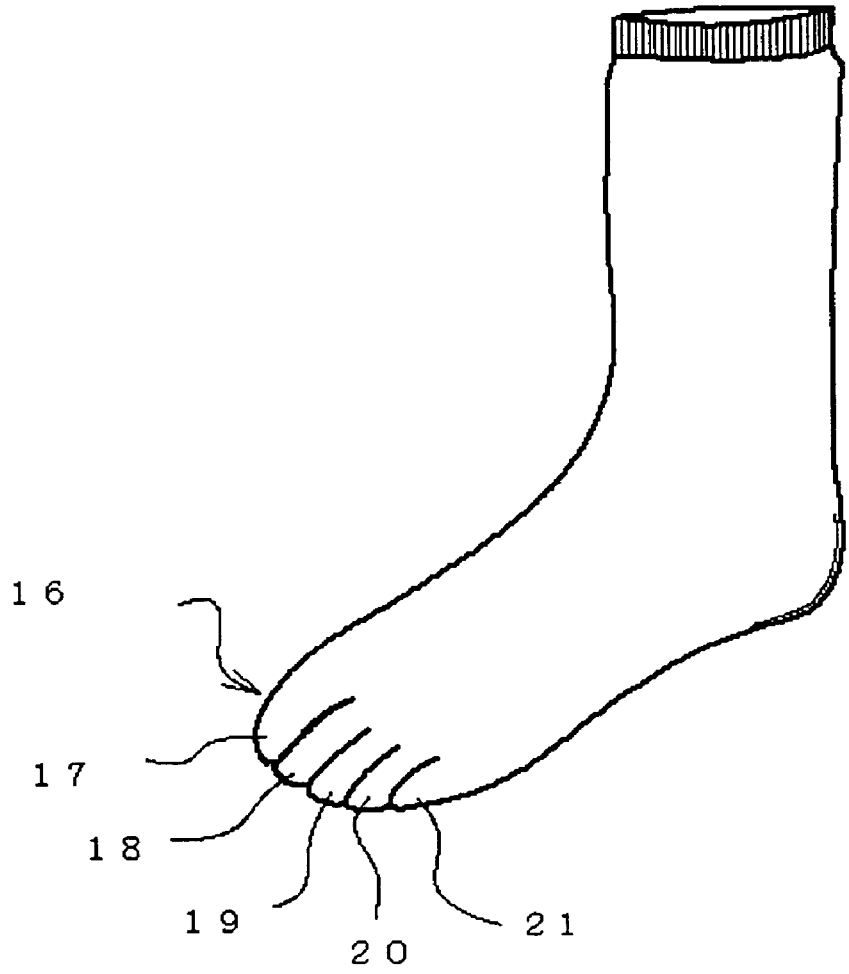
FIG. 8 is a pictorial view showing the external appearance of another example of a change in shape of the invention.

Also, as in the toe section indicated by reference number 16 in FIG. 8, the toe section 16 can formed such that it is divided into a first to a fifth insert section 17 to 21, and it is not shown in the figure, however, it is also possible to form bulge sections for each of these insert sections 17 to 21.

With this kind of construction, while maintaining the fit described above, each toe is independently covered so it is possible to eliminate sweating and the like, and make wearing the sock more comfortable.

Also, in the case where insert sections 17 to 21 that correspond to the toes are formed, resistance to the insertion of the toes is increased, however, in this invention, since bulge sections are formed in each of the insert sections to 17 to 21, the aforementioned insert resistance is reduced, and the sock can be put on smoothly.

Furthermore, the insert section described above could also be an insert section for an arbitrary number of toes that covers from the index toe (second toe) to the next to the last toe (fourth toe).

Also, the cylindrical knit section 2 described above could be changed among various shapes such as a shape that covers the calf, a shape that covers the ankle, or a shape that covers to just below the ankle.

INDUSTRIAL APPLICABILITY

As described above, with this invention, when knitting the sole section and instep section, knitting is performed while sequentially decreasing the number of stitches on the small-toe side by a specified number, and after the number of stitches on the large-toe side have been decreased by a rate larger than the rate of decreasing the number of stitches on the small-toe side, the number is increased by the same rate, and by doing this, on the small-toe side, the side edge section goes toward the tip end and deviates to the inside at a specified rate, and on the large-toe side, in the area where the number of stitches is increased, the appearance is such that the side edge is nearly a straight line toward the tip end.

By doing this, the shape of the tip end of the toe section can be shaped such that the large-toe section protrudes such that it gradually extends toward the front of the toes going from the small-toe side to the large-toe side, and is shaped that runs along the curve that is obtained by connecting the tip end sections of the toes; and as a result, together with being able to relieve the feeling of pressure due to the difference in length of the toes, since the toe section stretches uniformly when putting on the sock, it is possible to suppress the advancement of damage in particular areas.

Also, on the large-toe side, a bulge section is formed that bulges in the direction of thickness of the sock, and this makes it possible to easily insert the large toe.

EXPLANATION OF REFERENCE NUMBERS

1 Sock
2 Cylindrical knitted section
3 Toe section
3*a* Sole section
3*b* Instep section
10 Toe section
10*a* Sole section
10*b* Instep section
13 Toe section
14 First insert section
15 Second insert section
16 Toe section
17 First insert section
18 Second insert section
19 Third insert section
20 Fourth insert section
21 Fifth insert section
V Small-toe side
W Large-toe side
X Knitting line
Y Knitting line

What is claimed is:

1. A method for knitting socks that is a method of forming the toe section of the sock that covers the toes into a cylindrical shape by continuously knitting from either a sole section or instep section to the other section, wherein when knitting said sole section and instep section, knitting is performed by sequentially decreasing the number of stitches of the small-toe side by a specified number, and after the number of stitches of the large-toe side is decreased by a rate that is greater than the rate of decreasing the number of stitches on said small-toe side, the number of stitches of the large-toe side is increased by the same rate of said large-toe side, and wherein the increase and decrease of the number of stitches on the large-toe side is meticulously repeated at a minimum increase-decrease rate.

2. The method of knitting socks of claim 1 wherein the increase and decrease of the number of stitches on said large-toe side is performed continuously over a specified length at an integral multiple of the minimum increase-decrease rate.

3. The method of knitting socks of claim 1 wherein said toe section is formed by dividing it into a first insert section into which the large toe is inserted, and a second insert section into which the other toes are inserted, and when knitting the sole section or instep section in the first insert section and section insert section, the number of stitches is increased or decreased.

4. The method of knitting socks of claim 1 wherein said toe section is formed such that it is divided into five insert sections into which the toes are individually inserted, and when knitting the sole section or instep section in each of these five insert sections, the number of stitches is increased or decreased.

* * * * *